US005943016A

United States Patent [19]

Snyder, Jr. et al.

[11] Patent Number: 5,943,016

[45] Date of Patent: Aug. 24, 1999

[54] TUNABLE MICROSTRIP PATCH ANTENNA AND FEED NETWORK THEREFOR

[75] Inventors: Robert F. Snyder, Jr., New Freedom, Pa.; James D. Lilly, Silver Spring; Andrew Humen, Jr., Crofton, both of Md.

[73] Assignee: Atlantic Aerospace Electronics, Corp., Greenbelt, Md.

[21] Appl. No.: 08/844,929

[22] Filed: Apr. 22, 1997

Related U.S. Application Data

[63] Continuation-in-part of application No. 08/568,940, Dec. 7, 1995, Pat. No. 5,777,581.

[51] Int. Cl.[6] ..... H01Q 1/26

[52] U.S. Cl. ..... 343/700 MS; 343/701

[58] Field of Search ..... 343/700 MS

[56] References Cited

U.S. PATENT DOCUMENTS

| | | | |
|---|---|---|---|
| 3,681,697 | 8/1972 | Moroney | 325/446 |
| 4,016,516 | 4/1977 | Sauter et al. | 333/81 R |
| 4,479,100 | 10/1984 | Moghe et al. | 333/33 |
| 4,489,271 | 12/1984 | Riblet | 324/58 B |
| 4,602,227 | 7/1986 | Clark et al. | 333/109 |
| 4,736,170 | 4/1988 | Wu et al. | 332/21 |
| 4,751,513 | 6/1988 | Daryoush et al. | 343/700 |
| 4,812,855 | 3/1989 | Coe et al. | 343/818 |
| 4,918,749 | 4/1990 | Entschalden et al. | 455/327 |
| 5,008,681 | 4/1991 | Cavallaro et al. | 343/700 |
| 5,119,042 | 6/1992 | Crampton et al. | 330/295 |
| 5,233,317 | 8/1993 | Snodgrass et al. | 333/81 A |
| 5,389,937 | 2/1995 | Kaloi | 343/700 |
| 5,420,596 | 5/1995 | Burrell et al. | 343/700 |
| 5,517,687 | 5/1996 | Niehenke et al. | 455/325 |
| 5,777,581 | 7/1998 | Lily et al. | 343/700 MS |

*Primary Examiner*—Frank G. Font
*Assistant Examiner*—Roy M. Punnoose
*Attorney, Agent, or Firm*—Pillsbury Madison & Sutro, LLP

[57] ABSTRACT

A patch antenna is provided with one or more tuning strips spaced therefrom and RF switches to connect or block RF currents therebetween. When a conducting path for RF current is connected between the tuning strips and the patch, the tuning strips increase the effective length of the patch and lower the antenna's resonant frequency, thereby allowing the antenna to be frequency tuned electrically over a relatively broadband of frequencies. If the tuning strips are connected to the patch in other than a symmetrical pattern, the antenna pattern of the antenna can be changed. A feed network couples RF to the antenna and includes two hybrid couplers, one for providing the correct amplitude and phase of excitation at the feed probes, and the second for effectively dissipating reflected power due to antenna impedance mismatch.

24 Claims, 12 Drawing Sheets

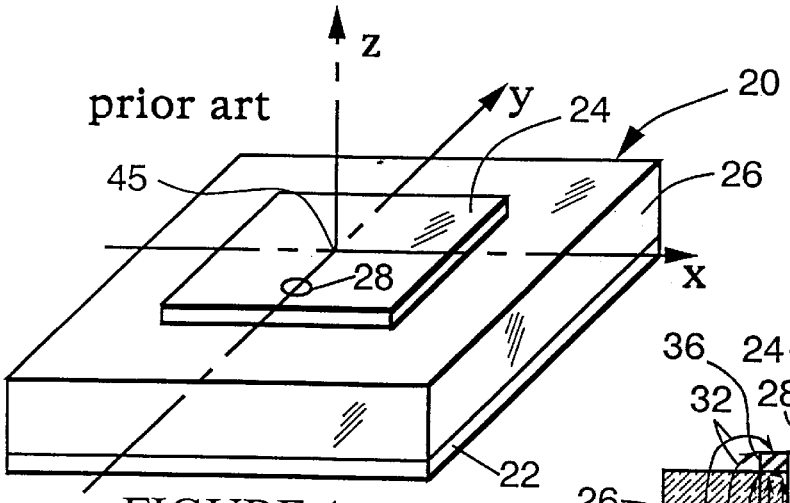
FIGURE 1
FIGURE 2
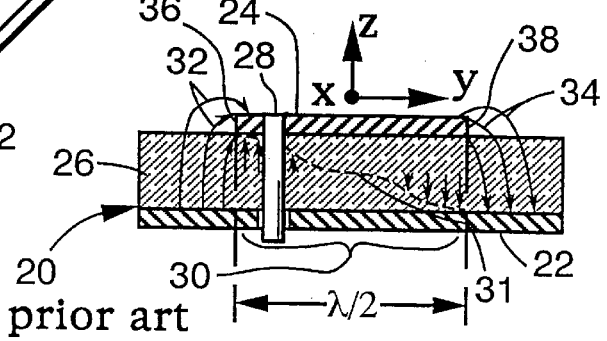
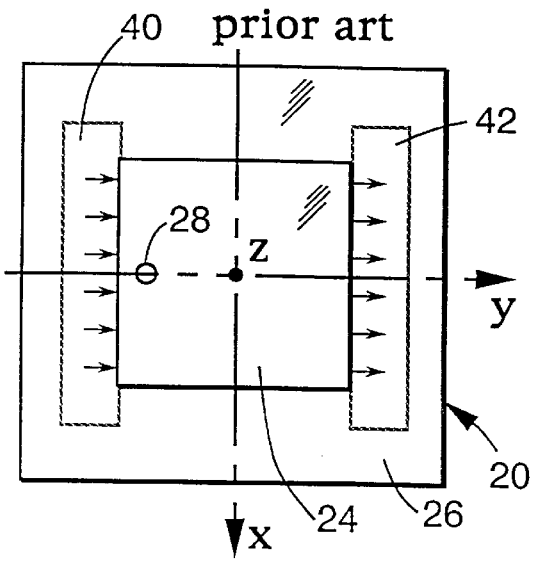
FIGURE 3
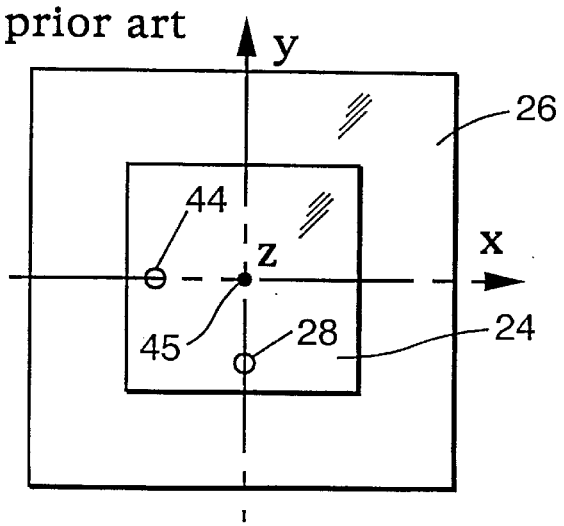
FIGURE 4

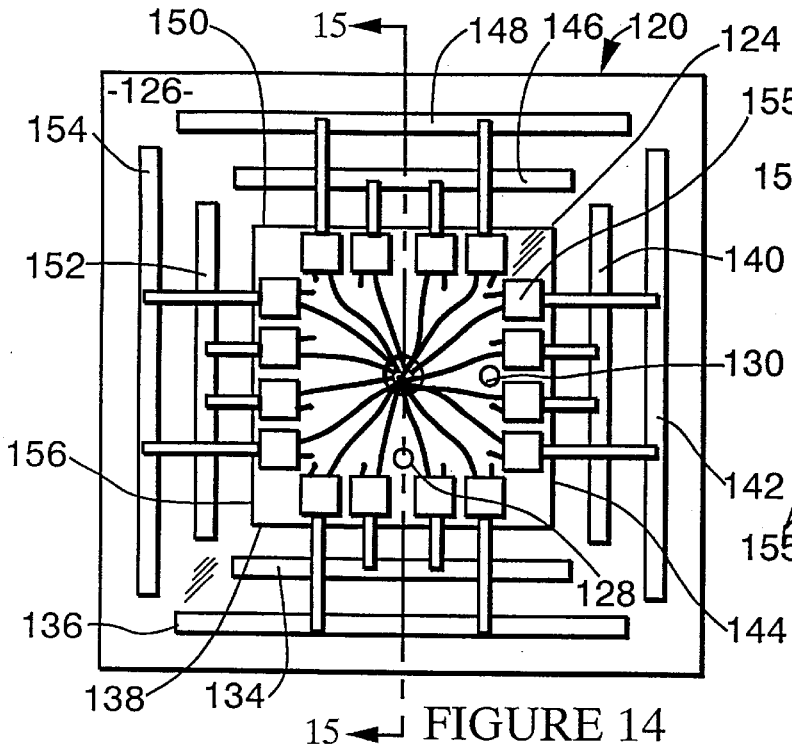
FIGURE 14
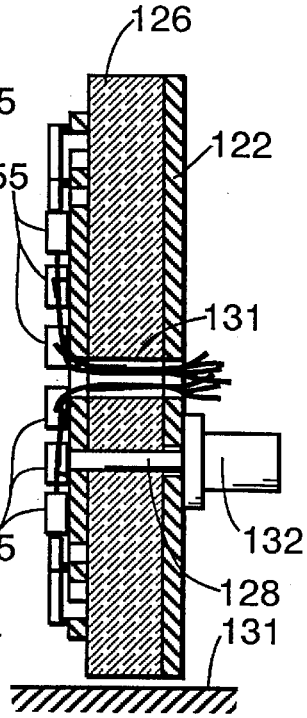
FIGURE 15
FIGURE 16
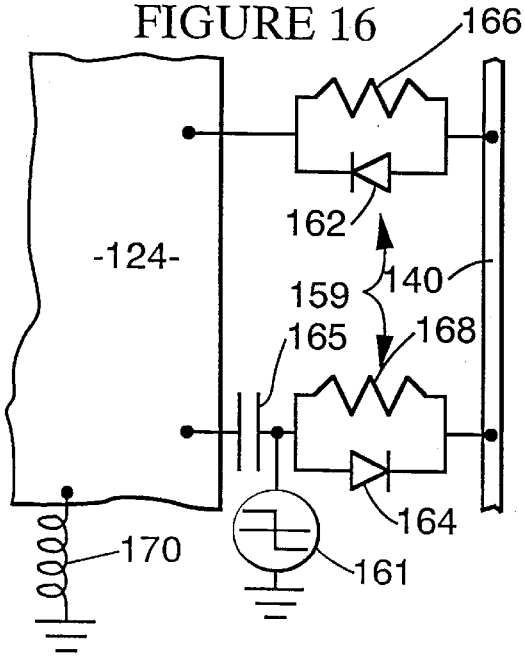
FIGURE 17
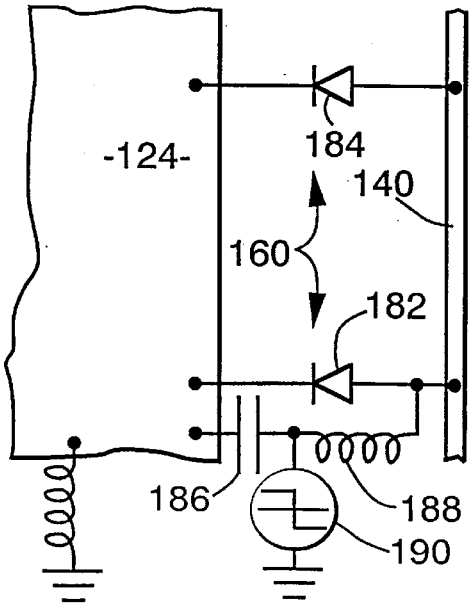

TUNABLE MICROSTRIP PATCH ANTENNA AND FEED NETWORK THEREFOR

This is a continuation-in-part application of U.S. Pat. No. 5,777,581, U.S. application Ser. No. 08/568,940 filed Dec. 7, 1995.

BACKGROUND OF THE INVENTION

Many applications require small, light weight, efficient conformal antennas. Traditionally, microstrip patch antennas have been a preferred type for many applications. These applications tend to be only over a narrow frequency band, since microstrip patch antennas typically are efficient only in a narrow frequency band. Otherwise, the advantages of these antennas of being mountable in a small space, of having high gain and of being capable of being constructed in a rugged form, have made them the antennas of choice in many applications.

Satellite communication (Satcom) systems and other similar communications systems require relatively broadband antennas. Typical military broadband applications include long range communication links for smart weapon targeting and real time mission planning and reporting. A variety of antenna designs, such as crossed slots, spirals, cavity-backed turnstiles, and dipole/monopole hybrids have been used for similar applications over at least the last 15 years. However, most of these antennas require large installation footprints, typically for UHF antennas, a square which is two to three feet on a side. When used on aircraft, these antennas intrude into the aircraft by as much as 12" and can protrude into the airstream as much as 14". For airborne Satcom applications, antennas of this size are unacceptably large, especially on smaller aircraft, and difficult to hide on larger aircraft, where it is undesirable to advertise the presence of a UHF Satcom capability. Therefore, there has been a need for a small highly efficient broadband antennas.

As illustrated in FIG. 29, further problems arise when attempting to couple the feeds 406 and 408 of a microstrip antenna 404 to a power generator 402, especially in high power applications. It is generally desirable to present a power generator with a good load match, i.e. VSWR, at all limes. That is, it is generally desirable to minimize the amount of reflected power $P_r$, such as that due to antenna impedance mismatch, that is reflected back from the antenna to the power generator. Moreover, it is sometimes necessary to feed the antenna with a phase shift.

Typically, a 90° hybrid coupler 400 such as that illustrated in FIG. 29 will provide the desired phase while allowing the power reflected back from the antenna 404 to be absorbed and dissipated by a termination 410. The amount of power that can be dissipated by the termination, however, is dependent on the physical size of the termination. The dissipated power creates excess heat which can burn out the termination if it is too small. In high power applications, this means that a physically large termination is required to absorb the reflected power caused by antenna mismatch. Moreover, the termination must be located away from the antenna assembly. Therefore, there has also been a need in the art for a feed network that can effectively present a good load match between a power generator and a microstrip antenna, but that does not occupy a large amount of space.

SUMMARY OF THE INVENTION

The present tunable microstrip patch antenna is small, light weight and broadband. The small size enables use in the aforementioned applications where larger, less efficient, and/or narrow band antennas have heretofore been used. Although the antenna is discussed as if it is a transmitting antenna, the same principles apply when it is being used as a receiving antenna. The antenna includes a conductive patch, generally parallel to and spaced from a conducting ground plane by an insulator, and fed at one or more locations through the ground plane and the insulator. The shape of the patch and the feed points determine the polarization and general antenna pattern of the antenna. Surrounding the patch are conductive strips. Circuitry is provided to allow the strips to participate in the function of the antenna or to isolate the strips from such function. When the strips participate, they effectively increase the size of the patch and lower its optimal operation frequency.

The participation of the strips can be accomplished in various ways. A preferred method uses diodes and means to either forward or back bias the diodes into conductive or nonconductive conditions. The diodes can be used to connect the strips to the main patch, or to ground them to the ground plane to prevent capacitive coupling between the strips and the patch from being effective. Typically the strips are arranged in segmented concentric rings about the patch, the rings having the same approximate edge shape as the patch. Normally, the strips are connected to the patch progressively outwardly from the patch to lower the frequency of the antenna. However, various combinations of the strips may be connected or disconnected to tune the antenna to specific frequencies or to change the associated gain pattern.

Although UHF Satcom is a prime candidate for application of the present invention, and is discussed hereinafter in that context, nowhere herein is this meant to imply any limitation and potential use of frequency or of operation and in fact the present antennas are useful in many different antenna applications, such as UHF line of sight communications, signal intercept, weapons data link, identification friend-or-foe ("IFF") and multi-function applications combining these and/or other functions.

Conventional UHF Satcom antennas provide an instantaneous bandwidth of approximately 80 Mhz covering the frequency band from 240 to 320 Mhz. The present antennas can be configured to cover the required 80 Mhz bandwidth with a number of sub-bands each with less instantaneous bandwidth than 80 MHz, but far more than required for system operation by any user. Since the present antenna may be tuned to operate at any sub-band, it thereby can be used to cover the entire 240 to 320 MHz Satcom band in a piece-wise fashion. The relatively narrow instantaneous bandwidth of the present antennas allow substantial size and weight reduction relative to conventional antennas and acts like a filter to reject unwanted out-of-subband signals, thereby reducing interference from nearby transmitters, jammers and the like.

The present antennas include tuning circuitry, thereby minimizing the need for external function and support hardware. The prior art microstrip patch configuration is modified to include conducting metal strips or bars spaced from and generally parallel to the basic patch element. Switching elements bridge the gaps between the basic patch element and the conducting metal strips. The switching elements allow any combination of the adjacent strips to be selected such that they are either electrically connected to or isolated from the basic patch. Switching components include PIN diodes, FETs, bulk switchable semiconductors, relays and mechanical switches. When for example PIN diodes are used, the present antenna is compatible with electronic control, that is, in response to DC currents, the antenna can be dynamically tuned for operation at specific RF frequencies. Because the control is electronic, very rapid tuning is possible, rapid enough in fact, to support TDMA and frequency hopping applications.

A feed network for the present antennas uses an additional hybrid network to distribute heat and includes a third low power termination to absorb secondary reflections from the high power terminations. Because the power is distributed among the additional terminations, the overall physical size of each individual termination can be reduced, while reliable power-load matching can be ensured even with wide variations in antenna impedance mismatch.

Therefore, it is an object of the present invention to provide a small, light weight, efficient, broadband antenna.

Another object of the present invention is to provide a broadband antenna, which can be tuned for efficient operation at a single frequency and whose antenna pattern can be tailored electronically.

Another object is to provide an electronically tunable antenna that is relatively easy and economical to manufacture.

Another object is to provide a tunable antenna that is useful over a wide range of applications and frequencies.

Another object is to provide an electrically small, broadband, tunable, efficient antenna, which can handle high power.

Another object is to provide an antenna that can be installed conformally to an arbitrarily curved surface.

Another object is to provide electronically tunable antennas that can be scaled for various frequency bands.

Another object is to provide an electronically tunable antenna with specific polarization or whose polarization can be changed or varied.

Another object is to provide a feed network that can effectively minimize the reflected power from the tunable antenna back to a power generator.

Another object is to provide a feed network that can reliably dissipate reflected power due to impedance mismatch of the tunable antenna.

Another object is to provide a feed network that provides a proper phase shift to feed the tunable antenna.

Another object is to provide a feed network that is capable of high power applications but that does not require physically large high power terminations.

BRIEF DESCRIPTION OF THE DRAWINGS

These and other objects and advantages the present invention will become apparent to those skilled in the art after considering the following detailed specification, together with the accompanying drawings wherein:

FIG. 1 is a perspective view of a prior art microstrip patch antenna;

FIG. 2 is a cross sectional view taken along the y-axis of FIG. 1.

FIG. 3 is a top plan view of the antenna of FIG. 1 showing the virtual radiating slots thereof;

FIG. 4 is a top plan view of a dual feed embodiment of the antenna of FIG. 1;

FIG. 14 is a top plan view of an antenna constructed according to the present invention, with its switch circuits, leads, and RF feeds;

FIG. 15 is a side cross-sectional view taken at line 15—15 of FIG. 14;

FIG. 16 is a circuit diagram of a switching circuit for connecting and disconnecting a tuning strip to the patch of the present antenna;

FIG. 17 is a circuit diagram of another switching circuit for connecting and disconnecting a tuning strip to the patch of the present antenna;

DETAILED DESCRIPTION OF THE PREFERRED EMBODIMENTS

Figure 5:
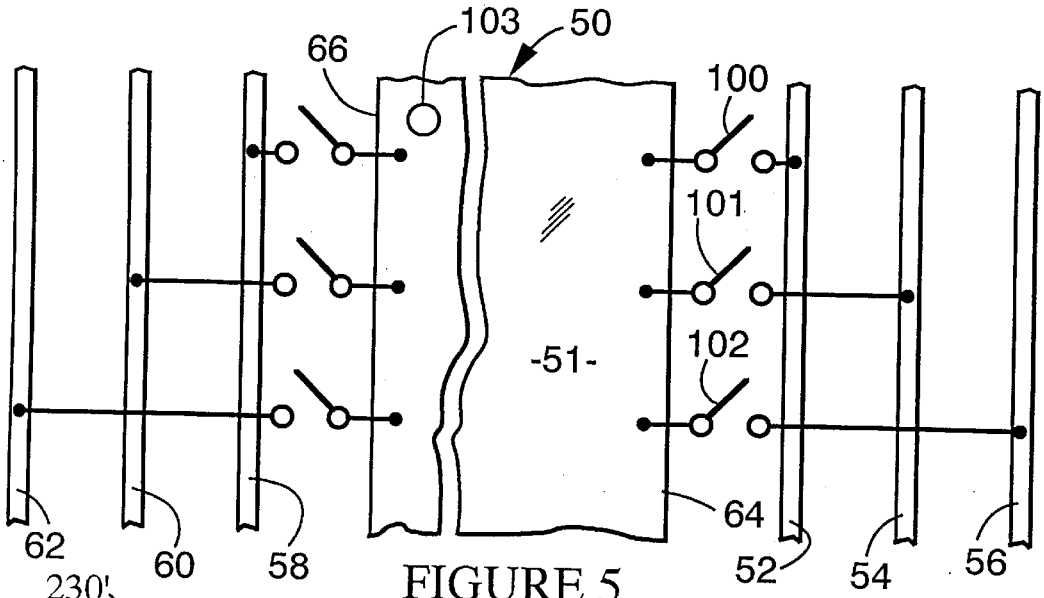
FIG. 5 is a partial diagrammatic plan view of an antenna constructed according to the present invention, showing a switch configuration thereof.

Referring to the drawings more particularly by reference numbers, number 20 in FIG. 1 refers to a prior art patch antenna that includes a conducting ground plane 22, a conducting patch 24 and a dielectric spacer 26 spacing the patch 24 parallel to and spaced from the ground plane 22. Suitable feed means 28 electrically insulated from the ground plane 22, extend therethrough and through the dielectric spacer 26 to feed RF energy to the patch 24. Although the patch 24 is shown as square in shape, it is also quite common to have circular patches either center fed or fed adjacent the edge as feed 28 is positioned. For any patch antenna operating in the lowest order mode, $TM_{11}$ for a circular patch and $T_{10}$ for a rectangular patch, a linearly polarized radiation pattern can be generated by exciting the patch 24 at a single feed point such as feed point 28. For antenna 20, which has a square patch that is a special case of a rectangular patch, the patch 24 generates a linearly polarized pattern with the polarization aligned with the y-axis. This can be understood by visualizing the antenna 20 as a resonant cavity 30 formed by the ground plane 22 and the patch 24 with open side walls as shown in FIG. 2. When excited at its lowest resonant frequency, the cavity 3 produces a standing half wave 31 ($\lambda/2$) when operating at the lowest order mode is shown, with fringing electric fields 32 and 34 at the edges 36 and 38 that appear as radiating slot 40 and 42 (FIG. 3). This electric field configuration has all field lines parallel with the y-axis and hence produces radiation with linear polarization. When a feed 44 is located on the x-axis as shown in FIG. 4, all electric field lines are aligned with the x-axis. If two feeds 28 and 44 are present simultaneously, one on the x-axis and the other on the y-axis as shown in FIG. 4, then two orthogonal electric fields are generated. Because the fields are orthogonal, they do not couple or otherwise affect each other and circular polarization results if the feeds are fed at 90 relative phase. With two feeds 28 and 44, four polarization senses can be generated. When feed 4 alone is used, there is linear horizontal polarization. When feed 28 only is used, there is linear vertical polarization. When feeds 28 and 44 are activated with feed 28, 90° in phase behind feed 44, then the antenna 20 radiates RF signals with right hand circular polarization. When feed 28 is fed 90° ahead of feed point 44, left hand circular polarization results. Therefore, with two feeds and the ability to switch between them, any of the four polarizations can be generated from a single antenna 20.

As shown in FIG. 2, the maximum electric field is positioned at the edges 36 and 38 of the patch 24 whereas the minimum electric field occurs at the center 45 of the patch 24. At some intermediate positions between the center 45 and the edges of the patch 24, impedances occur that may match the characteristic impedance of the transmission line of feed 28. The feeds 28 and 44 are preferably placed so the impedances perfectly match.

Figure 6:
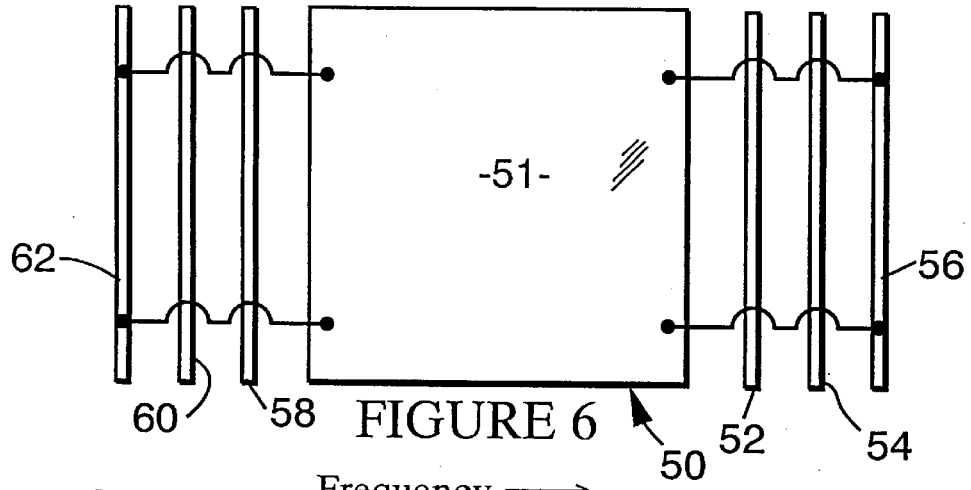
FIG. 6 is a top plan view showing how the tuning strips of an embodiment of the present invention can be connected to the patch thereof.
Figure 7:
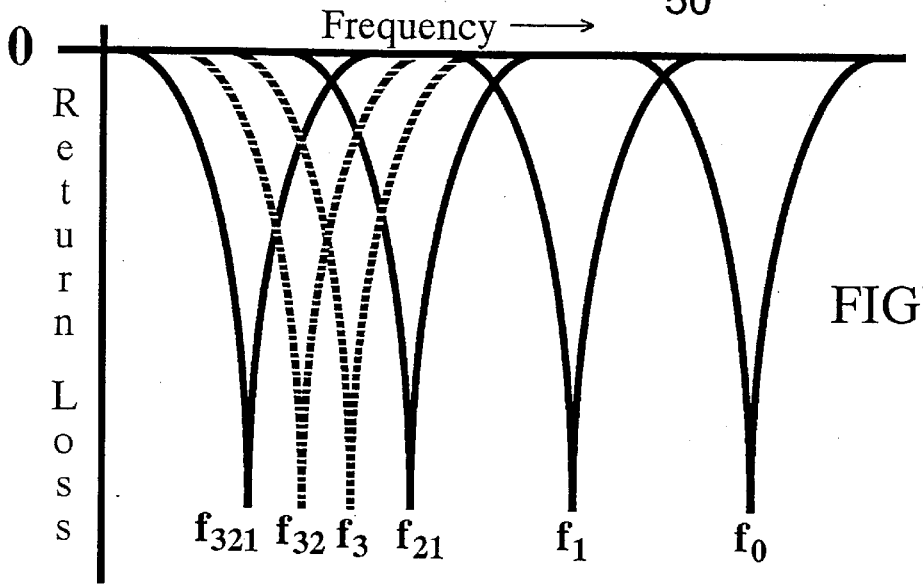
FIG. 7 is a graph of typical Frequency vs. Return Loss for various tuning stales of the antenna of FIG. 6, where the frequency subscript designates the particular tuning strips electrically connected to the patch.

A simplified antenna 50 constructed according to the present invention is shown in FIG. 5 with only one polarization shown for simplicity. The antenna 50 and other antennas constructed in accordance with the present invention to be described hereinafter, are shown on a planar ground plane even though all of the present antennas can by curved within reason to confirm to curved or compound curved surfaces of air vehicles or other supporting structure on or in which they may be mounted. The antenna 50 includes a patch 51 with three equally-spaced tuning bars or strips 52, 54, 56 and 58, 60 and 62 on opposite sides 64 and 66 of the patch 51. The resonant frequency of the antenna 50 is inversely proportional to the total effective patch length, that is the length of the patch 51 plus any of the strips 52 through 62 connected thereto. Therefore, the highest resonant frequency of the antenna 50 occurs when all of the strips 52 through 62 are disconnected from the patch 51. Possible operating states that can be generated with antenna 50 include $f_{highest}$ ($f_O$) for just the patch 51, $f_{mid\text{-}high}$ ($f_1$) for the patch 51 with strips 52 and 58 connected, $f_{mid\text{-}low}$ ($f_{21}$) for the patch 51 with strips 52, 54. 58 and 60 connected and $f_{lowest}$ ($f_{321}$) for the patch 51 with all of the strips 52 through 62 connected. However, the antenna 50 can be used with some of the outermost strips like 56 and 62 connected and the remaining strips disconnected (FIG. 6) to produce an operating frequency $f_3$ somewhat higher than $f_{lowest}$ ($f_{321}$) as shown in FIG. 7, which is a graph of return loss versus frequency. Another possible configuration has the patch 51 connected to strips 54, 56, 60 and 62 but not strips 52 and 58 to produce a frequency $f_{32}$ just above $f_{lowest}$. The extra frequencies that are possible by connecting different combinations of strips allow antennas of the present invention to be designed with fewer tuning strips and connecting components, while still providing continuous coverage over the frequency range of interest.

Figure 8:
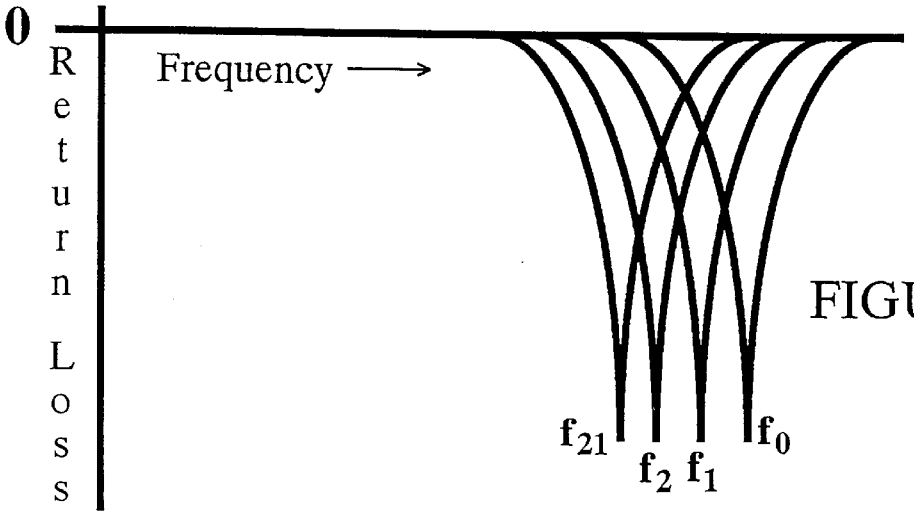
FIG. 8 is a graph of Frequency vs. Return Loss for the antenna of FIG. 9, which can be finely tuned.
Figure 9:
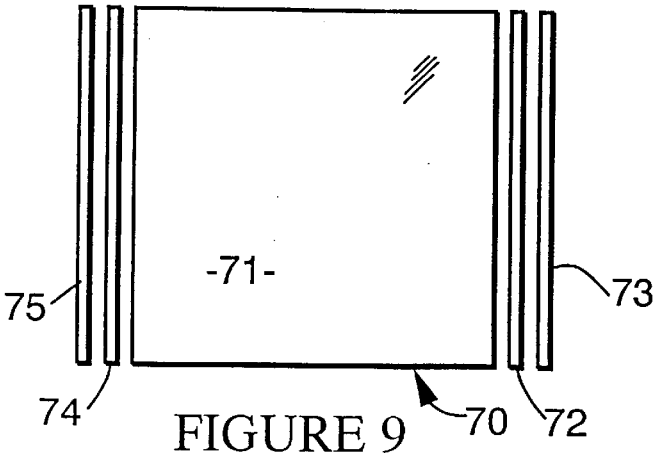
FIG. 9 is a partial top plan view of the tuning strips and patch of an antenna constructed according to the present invention, showing how tuning strips are positioned and spaced when the antenna is to be finely tuned at frequencies near the resonant frequency of the patch alone.
Figure 10:
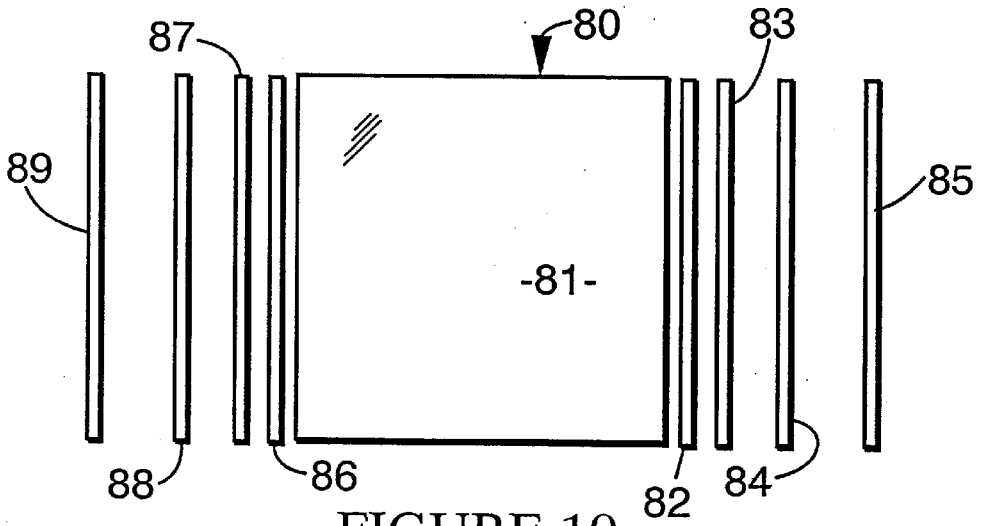
FIG. 10 is a partial top plan view of the tuning strips and patch of an antenna constructed according to the present invention, showing how tuning strips are positioned and spaced when the antenna is to cover a broad RF frequency band.
Figure 11:
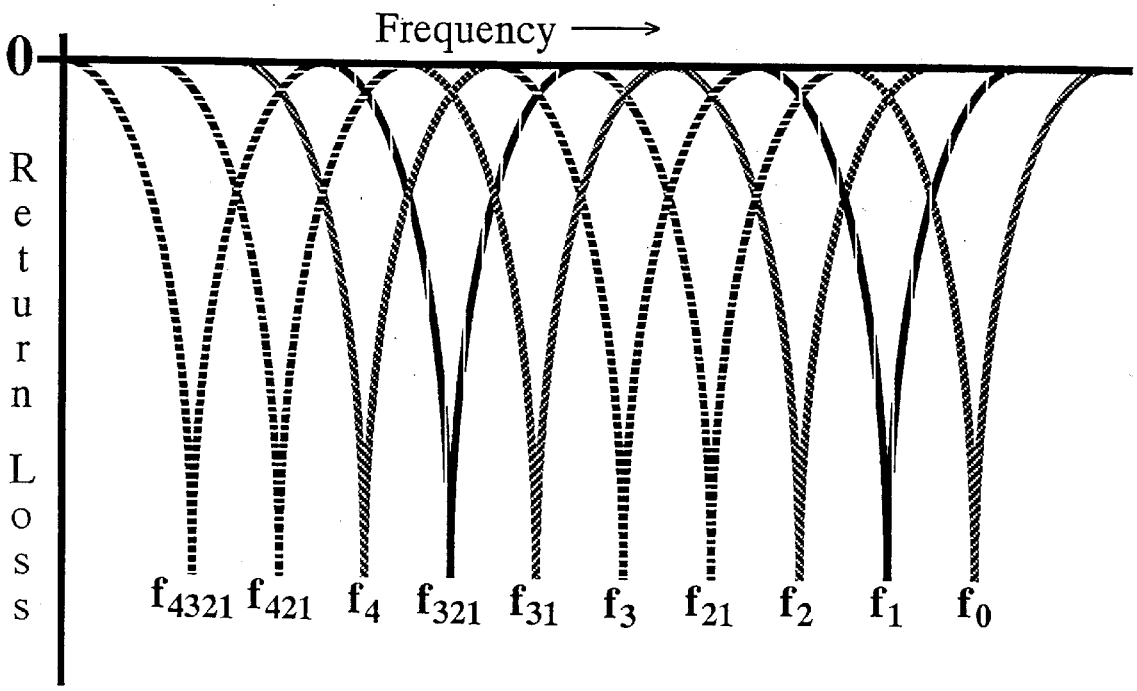
FIG. 11 is a graph of Frequency vs. Return Loss for various tuning states of the antenna of FIG. 10.

The tuning strips do not have to be equally spaced and fewer more widely spaced strips make the present antenna simpler and less costly to build. For the high frequency tuning states that employ only the innermost strips, these extra tuning states are less available. For example, if the frequency coverage shown in FIG. 8 is required, a patch of the antenna 71 with closely spaced tuning strips 72, 73 74 and 75 can be used (FIG. 9). The strips 72 and 74 must be located sufficiently close to the patch 71 that frequency $f_1$ is generated. Any combination of other strips located further from the patch 71 will generate an operating frequency lower than $f_1$. Similarly, tuning strips 73 and 75 will generate the next lowest frequency $f_2$. Therefore, a broadband design may appear as shown in FIG. 10 by antenna 80, which includes patch 81 and tuning strips 82, 83, 84, 85, 86, 87, 88 and 89. Note the narrow spacing between the patch 81 and the strips 82 and 86 and then that the spacing increases outwardly so as shown on FIG. 11, a relatively even spread of frequencies can be obtained either by using individual strips or combinations, the frequencies being shown with subscript numbers indicating the connected strips counting outwardly from the patch 81. The resonant frequency patch 81 alone is $f_0$.

Figure 12:
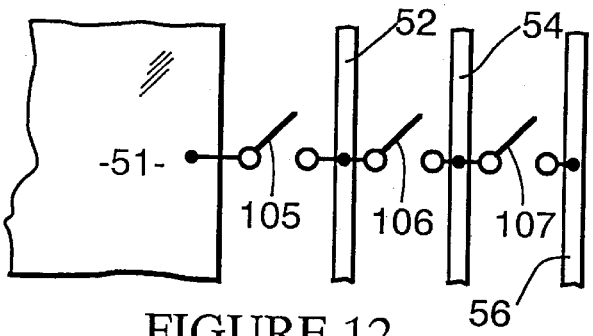
FIG. 12 is a partial diagrammatic plan view of an antenna constructed according to the present invention, showing a alternate switch configuration thereof.
Figure 13:
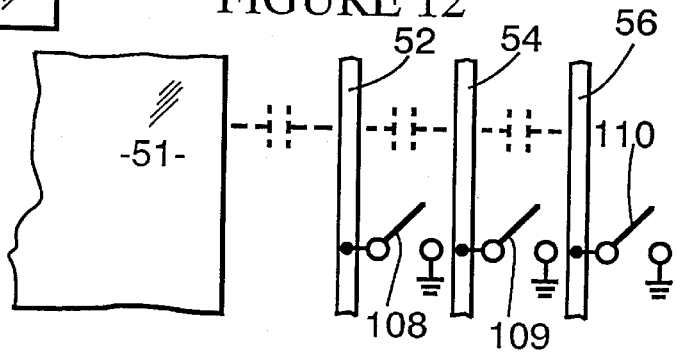
FIG. 13 is a partial diagrammatic plan view of an antenna constructed according to the present invention, showing a alternate switch configuration thereof that grounds the tuning strips rather than connects them to the patch, useful when the strips capacitively couple to the patch.

As shown in FIGS. 5, 12 and 13, the tuning strips 52, 54 and 56 can be coupled to the patch 51 by different switching arrangements. In FIG. 5, switches 100, 101 and 102 connect the tuning strips 52, 54 and 56 in parallel to the patch 51 so that any combination can be connected thereto. If only the strips 52, 54, and 56 are connected to the patch 51, the effect is to move the feed 103 percentage wise closer to the edge 66 to affect the antenna pattern and/or impedance match. In FIG. 12, switches 105, 106, and 107 connect the tuning strips 52, 54 and 56 in series. In this configuration, an interior tuning strip cannot be skipped to tune between what would normally be tuning strip frequencies.

At high frequencies, the strips preferably are positioned very close together because they must be wide enough to carry the RF currents yet located at small distances from the patch. When they are positioned close to the patch, capacitance therebetween is high enough to couple RF between the strips and the patch and make the connection circuitry of FIGS. 5 and 12 ineffective to isolate the strips from the patch. Therefore, as shown in FIG. 13, switches 108, 109 and 110 are connected so they can ground the tuning strips 52, 54 and 56, which otherwise capacitively couple to the patch 51. In some instances, the switch connections of FIG. 13 and either FIG. 5 or 12 may need to be combined to get desired coupling and decoupling of the strips and the patch.

A microstrip patch antenna 120 constructed according to the present invention, whose thickness is exaggerated for clarity, can be seen in FIG. 14. The antenna 120 includes a conductive ground plane 122 and a square patch 124 supported and insulated from the ground plane 122 by a dielectric spacer 126. The patch 124 is fed by two leads 128 and 130, which are physically positioned at 90° to each other about the center hole 131 (FIG. 15) of the patch 124. When the antenna 120 is transmitting, the leads 128 and 130 connect RF signals that are electrically 90° degrees apart in phase to the patch 124 to produce circular polarization. As previously discussed, this causes the polarization of the antenna 120 to be right hand circular if lead 128 is fed 90° ahead of lead 130. If the phase difference of the leads 128 and 130 is reversed, the antenna 120 produces an output with left hand circular polarization If the antenna 120 is oriented as shown in FIG. 15 at 90° to the earth 131, and only lead 130 is fed, then the antenna 120 produces an output signal with a linear horizontal polarization. When only lead 128 is feeding the antenna 120, then an output signal with a linear vertical polarization is produced. As shown in FIG. 15, a suitable connector 132 is provided on each of the leads 128 and 130 for connection to RF producing or receiving means, the leads 128 and 130 being insulated or spaced from the ground plane 122, as shown. Note that other connection means may be employed in place of the connector 132, such as microstrip lines, coplanar waveguide coupling apertures, and the like.

As aforesaid, relatively conventional patch antennas employing a patch 124 above a ground plane 122 and fed as described, are fairly conventional, efficient narrow frequency band devices. To increase the frequency coverage of the antenna 120 without affecting its antenna pattern, operation modes, or polarization, conductive frequency broadening strips are positioned on the spacer 126 parallel to and spaced from the patch 124 with strips 134 and 136 positioned near the lower edge 138 of the patch 124, strips 140 and 142 positioned near the right edge 144 of the patch 124, strips 146 and 148 positioned near the upper edge 150 of the patch 124, and strips 152 and 154 positioned near the left edge 156 of the patch 124.

When the strips 134, 140, 146 and 152 are connected by switch means 155 to the RF frequencies present at the patch 124, they effectively enlarge the patch 124 without changing its shape and thereby lower its resonant frequency. If in addition strips 136, 142, 148 and 154 are also connected to the patch 124, this further lowers the resonant frequency of the antenna 120. Intermediate frequencies can be gained by connecting only strips 136, 142, 148 and 154 to the patch 124 which has the effect of lowering the resonant frequency of the antenna 120 but not so much as if all strips were connected. In addition to changing the resonant frequency, the pattern of the antenna 120 can be changed by connecting the patch 124 to only opposite pairs of strips or connecting only the strips on one edge, adjacent edges or three edges. This allows the antenna to be mistuned in a chosen direction to reduce an interfering signal near or at the frequency of interest. With the symmetrical antenna 120, in almost every combination, the connecting of the strips, adjusts the resonant frequency of the antenna and/or adjusts its radiation pattern. With a non-symmetrical antenna of the present invention, it is difficult to change the resonantly frequency without changing the antenna pattern.

Figure 18:
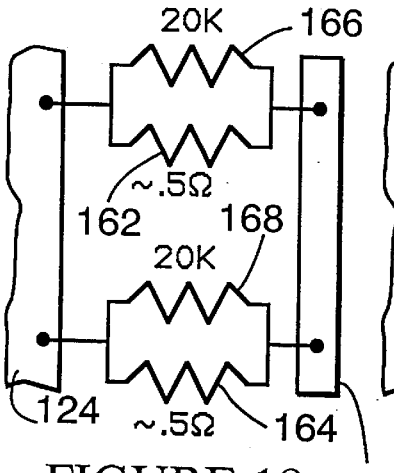
FIGS. 18 and 19 are equivalent circuit diagrams for the switching circuit of FIG. 16 when the circuit is connecting the patch to the tuning strip.
Figure 19:
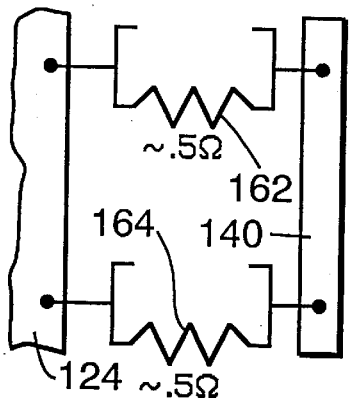
Figure 20:
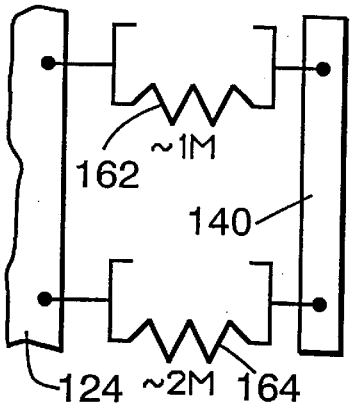
FIGS. 20 and 21 are equivalent circuit diagrams for the switching circuit of FIG. 16 when the circuit is disconnecting the patch from the tuning strip.
Figure 21:
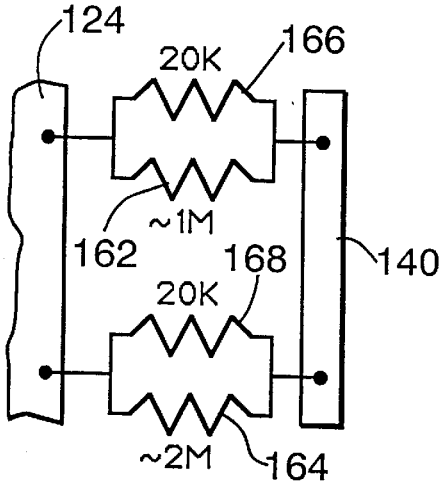

The patch 124 can be connected to the strips 134, 136, 140, 142, 146, 148, 152, and 154 by suitable means such as electronic switches, diodes, field effect transistors (FETs), EM relays and other electronic devices. Preferable circuits 159 and 160 are shown in FIG. 16 and 17 where PIN diodes are biased to either conduct or not conduct with a DC signal to connect a strip to the patch 124. A positive/negative DC power source 161 is used to bias diodes 162 and 164 either into conducting or non-conducting conditions. When both diodes, 162 and 164 are biased by a positive current from the power source 161 to conduct, the strip 140 is connected to any RF signal on the patch 124 an acts to expand the length thereof and thus lower the resonant frequency of the patch 124. The RF signal passes through a DC blocking capacitor 165 whose capacitance is chosen to act like a short to RF in the frequency band of interest. The RF signal then passes through the diode 164 (which when forward biased appears as a very low resistance of ~0.5 Ω), to the strip 140, and through the diode 162 connected between the patch 124 and the strip 140. Balancing resistors 166 and 168 are positioned in parallel to the diodes 162 and 164 respectively. Their resistances are chosen to be relatively high (typically 20 to 500 KΩ). They have no effect when the diodes 162 and 164 are conducting since the impedance of the diodes 162 and 164 is ~40,000 times less, the equivalent circuit at RF being shown in FIG. 18. Since the 0.5 Ω diodes 162 and 164 are so much lower in impedance than the 20 KΩ resistors 166 and 168, virtually all the RF current flows through the 0.5 Ω diodes 162 and 164, and the 20 KΩ resistors 166 and 168 act like open circuits as shown in FIG. 19. However, when the power source 161 back biases the diodes 162 and 164, the diodes 162 and 164 present a very high resistance of 1 MΩ or more, as shown in the equivalent circuit of FIG. 20. The circuit is then a voltage divider. If the diodes 162 and 164 are identical in back bias impedance, then the resistors 166 and 168 are not needed because an equal voltage drop occurs across each diode 162 and 164. However economical bench stock diodes can have an impedance difference as much as 1 MΩ. Therefore, as shown in FIG. 21, the diodes 162 and 164 if mismatched, become components in an unbalanced impedance bridge, which might allow RF signal to appear on the strip 140. With diode 162 having a back bias impedance of 1 MΩ and diode 164 having a back bias impedance of 2 MΩ, the voltage division created may not be enough to keep diode 162 biased off when RF is fed to the patch 124. The balancing resistors 166 and 168 avoid the problem by greatly reducing the effect of mismatched diodes since the parallel impedance of 1 MΩ diode 162 and 20 KΩ resistor 166 is 19.6 KΩ, whereas the parallel impedance of 2 MΩ diode 164 and 20 KΩ resistor 168 is 19.8 KΩ resulting in an insignificant voltage division of 49.75% to 50.25% across the diodes 162 and 164 respectively. An RF blocking coil 170 is used to complete the DC circuit to the power source 161 without allowing RF to ground out therethrough.

Figure 22:
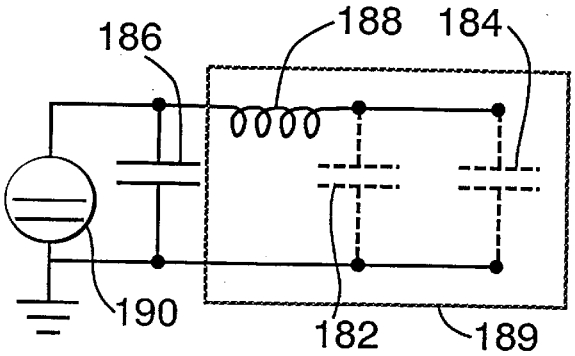
FIG. 22 is an equivalent circuit diagram for the switching circuit of FIG. 17 showing how a tuned filter formed thereby.
Figure 23:
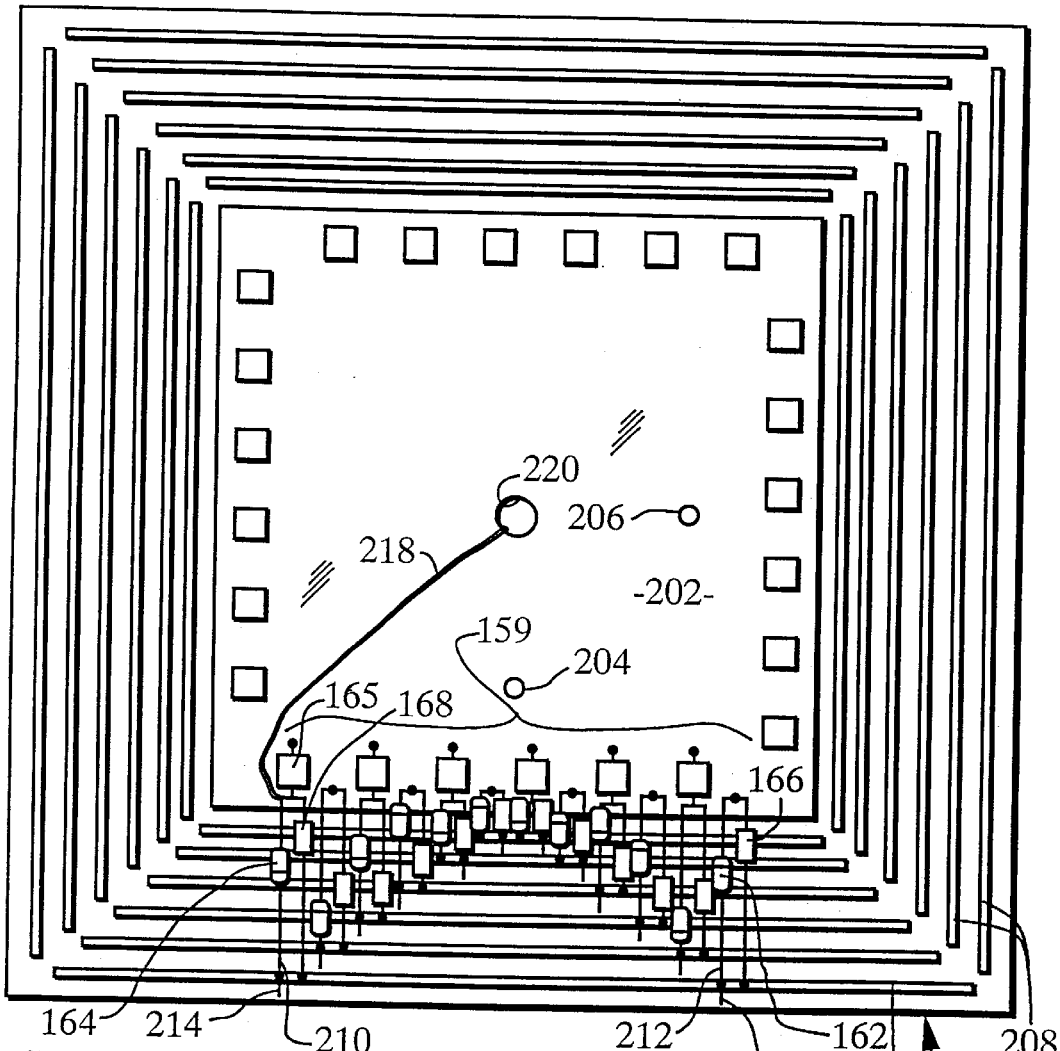
FIG. 23 is a top plan view of a broadband antenna being constructed according to the present invention with some of the switching circuits of FIG. 16 being in place thereon.

Another connection circuit 160 for connecting the patch 124 to strip 140 utilizing diodes 182 and 184 is shown in FIG. 17 wherein PIN diodes 182 and 184 are connected oriented in the same direction in parallel between the patch 124 and the strip 140 to avoid voltage division there between. The circuit 160 includes a capacitor 186 of a capacitance chosen to be a short circuit at RF frequencies and an open circuit at DC and an inductor 118 chosen such that, when combined with the parasitic capacitances of the diodes 182 and 184, the capacitor 186 and inductor 188 form a band stop filter 189 (FIG. 22). The series connected capacitor 186 and inductor 188 are fed DC therebetween by a DC power source 190 similar to the source 161, which can provide both positive and negative DC current thereto. The patch configuration is essentially the same for the parallel diode circuit 160 as for the series diode circuit 159 as to patch size, number of strips and strips facing. When forward biased by the power source 190, the diodes 182 and 184 conduct from the strip 140 to the patch 124 in a DC sense thereby forming a low resistance RF path. The advantage of circuit 160 over circuit 159 is that the resistors 166 and 168 are no longer required because the applied voltage is no longer divided between the two diodes 182 and 184. Also, each diode 182 and 184 is back biased to the entire output of the power source 190 as opposed to approximately ½ as in the case of circuit 159. This increases the bias voltage allowing the antenna to handle higher RF power or allows a more economical lower power source 190 to be employed. The band stop filter 189 provides additional isolation between the strip 140 and the patch 124. A disadvantage of the circuit 160 is that inductors 188 are generally more expensive than resistors. The partially constructed antenna 200 of FIG. 23 shows a typical embodiment of the present invention with the switching circuits 159 thereon. Like the aforementioned antennas, antenna 200 includes a patch 202 having feeds 204 and 206 symmetrically positioned at 90° to each other and on the horizontal and vertical axis of the patch 202. A plurality of spaced tuning strips 208 are symmetrically placed around the square patch 202 so that they can effectively increase its size when connected to the patch 202 by the switching circuits 159, one of which switching circuits 159 having the appropriate component numbers indicated, for connecting tuning strip 209 to the patch 202. Note that some of the leads 210 and 212 connecting to the tuning strip 209 extend outwardly beyond the tuning strip 209. The stubs 214 and 216 that result allow fine tuning of the antenna 200 once it has been constructed and can be tested. The stubs 214 and 216 are intentionally made longer than needed and then trimmed off to raise the resonant frequency of the antenna 200 when the strip 209 is connected.

Figure 24:
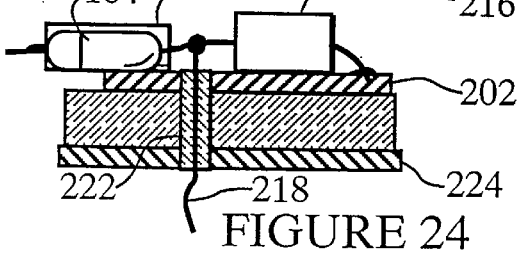
FIG. 24 is an enlarged cross-sectional view of an alternate arrangement to form the switching circuit of FIG. 16 on the antenna of FIG. 23.

The tuning circuits 159 are connected to the power source 161 by suitable leads, such as lead 218, which is shown extending through a center orifice 220 included for that purpose. As shown in FIG. 24, the lead 218 can also be fed through an insulator 222 that extends through the ground plane 224 and the patch 202 to connect to the capacitor 165, the diode 164 and the resistor 168. The lead 218 could also be an insulated plated-through hole. As the patch 202 is effectively enlarged by the addition of tuning strips with similar enlargement of the electric field standing wave (see FIG. 2), when the patch is enlarged uniformly, the impedance matches of the feeds 204 and 206 change. The original construction of the antenna 200 can be compromised for this by positioning the feeds 204 and 206 toward the strips so that a perfect impedance match occurs when some of the strips are connected symmetrically, or the strips can be connected asymmetrically so that as the effective patch size of the antenna increases, the effective center of the patch shifts away from the feed to keep it impedance matched. Additional strips 208 on the opposite edge from the feeds 204 and 206 can also be added so that strips can be asymmetrically added over the entire frequency band of the antenna. Which method is used for feed impedance matching in some measure depends on the ability of the connected transmitter or receiver to tolerate antenna feed mismatch and physical constraints that might prevent additional strips on sides opposite from the feeds 204 and 206. Whether any correction for impedance match changes is needed depends on the bandwidth being covered. Experiments have shown that no correction is required for the Satcom band discussed above.

Figure 29:
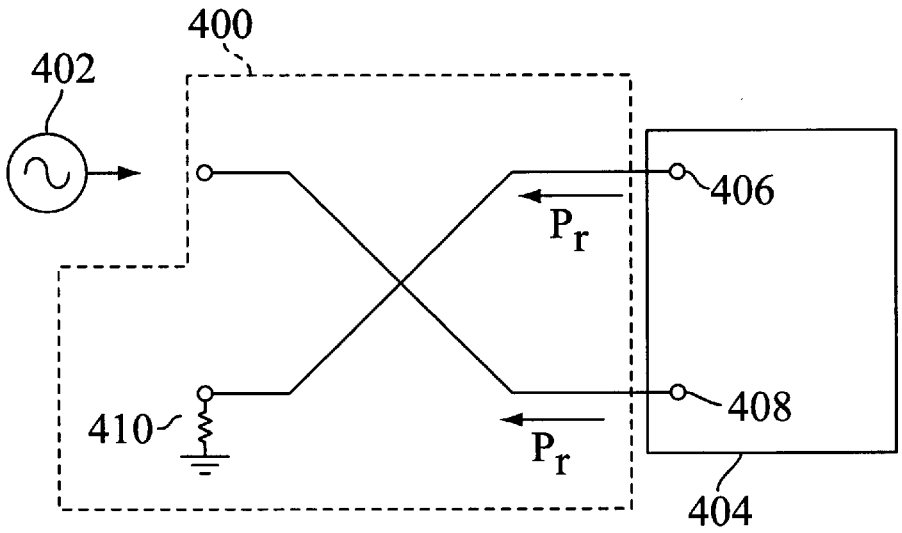
FIGURE 29 prior art
FIG. 29 is a block diagram of a conventional hybrid coupler circuit used in connection with an antenna.
Figure 30:
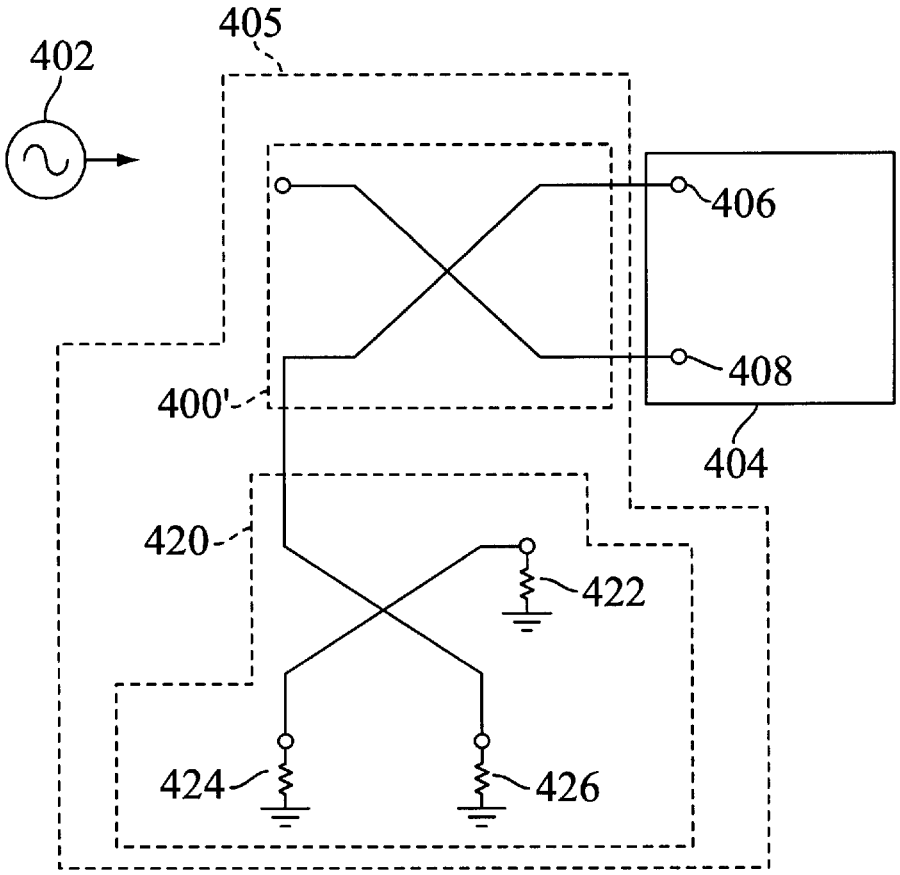
FIG. 30 is a block diagram of a feed network in accordance with the principles of the present invention.

A feed network that presents a good load match to a power source even when the feeds are not ideally matched, or when their impedance matching, changes due to the various connections of tuning strips with the patch, is shown in FIG. 30. As compared to the conventional hybrid coupler in FIG. 29, the present feed network 405 includes a second 3 dB hybrid 420 connected to the portion of first 3 dB hybrid 400' in place of the first high power termination 410 to distribute the beat and includes a third low power termination 422 to absorb any mismatch due to imperfections of the high power terminations 424 and 426. The reflected power from the antenna 404 is absorbed by the termination resistors of the second 3 dB hybrid 420, which includes the two high power terminations 424 and 426. Secondary reflections from the high power terminations are absorbed by the third termination 422. It should be noted that the antenna 404 can be any of the antenna:s described above with feeds 406 and 408 connected to the first hybrid coupler.

Figure 31:
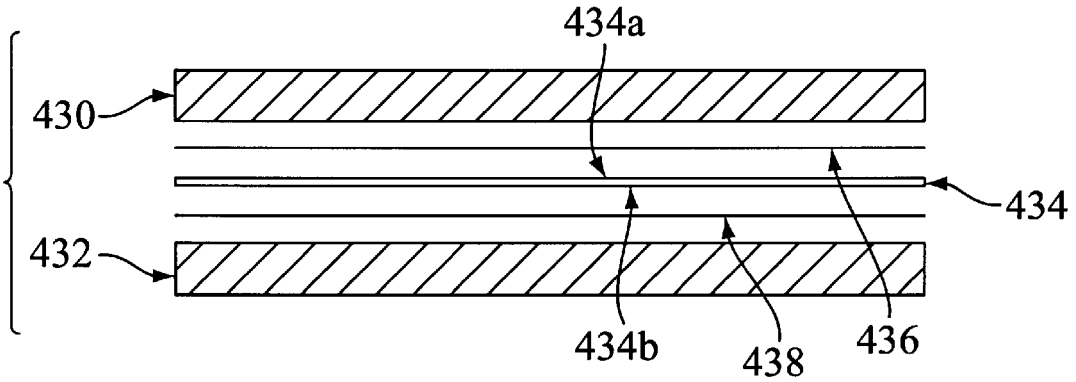
FIG. 31 is a side plan view of the construction of a feed network in accordance with the present invention.

The feed network can be embodied on a separate printed circuit board that is adapted to be mated to any of the antennas described above. As shown in FIG. 31, preferably the board is constructed as a stripline multi-layer PCB, comprised of two dielectric sheets 430 and 432 that sandwich a thin center circuit layer 434 having circuit artwork on a nearside **434*a* and farside 434*b* thereof. The center circuit layer can be mated to the dielectric sheets by bonding film 436 and 438**.

Figure 32:
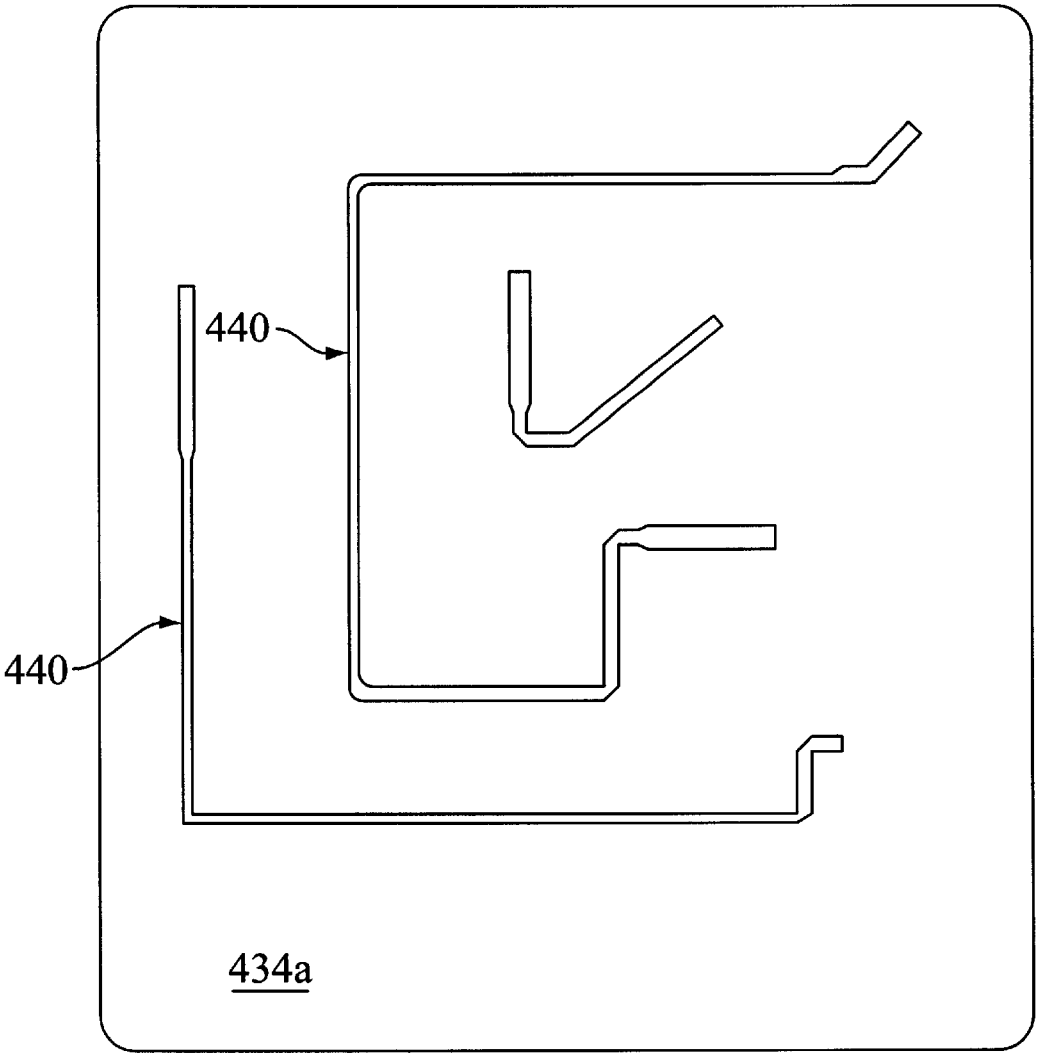
FIG. 32 is a top plan view of the nearside artwork on a circuit layer of a feed network constructed in accordance with the present invention.
Figure 33:
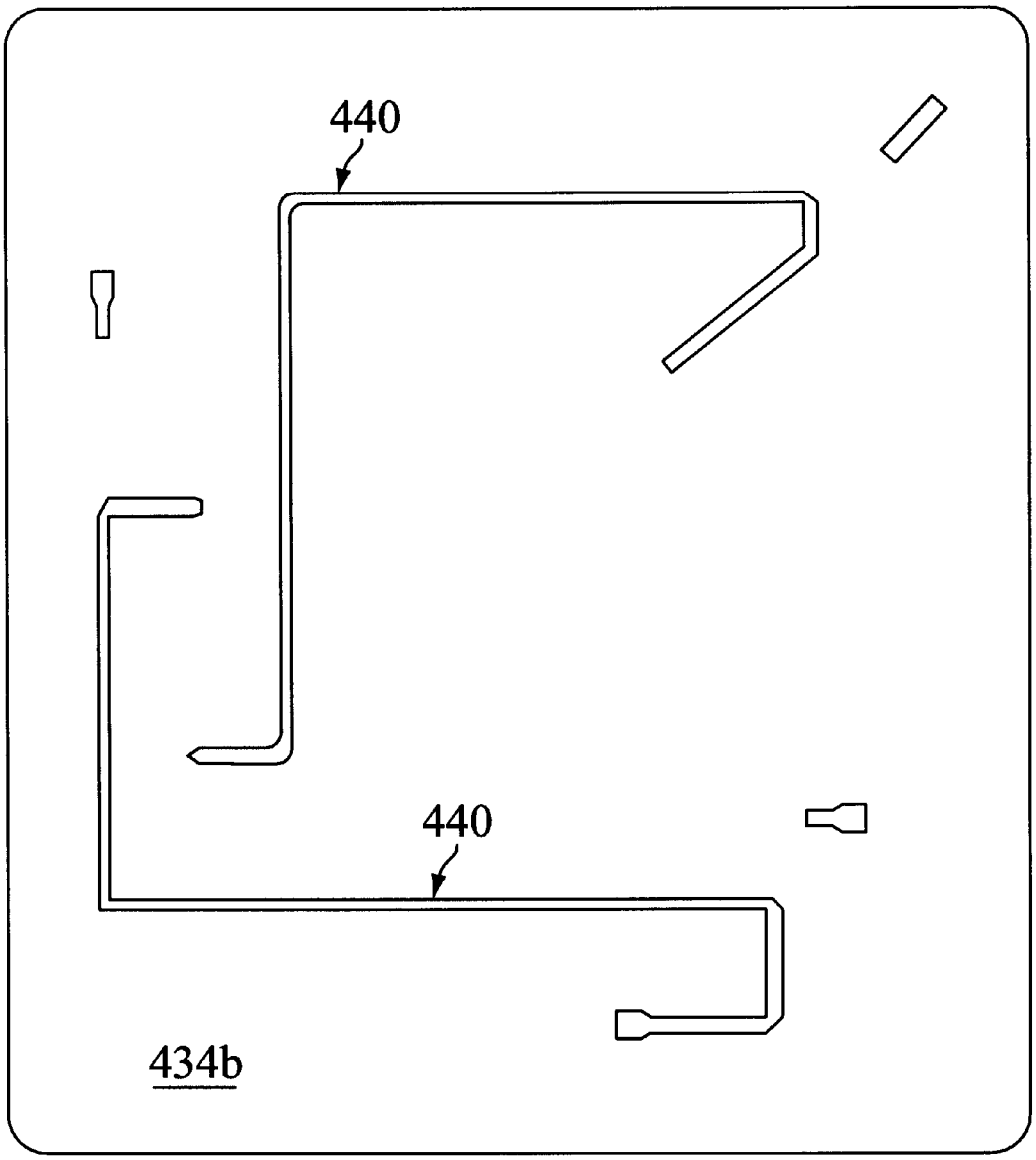
FIG. 33 is a top plan view of the farside artwork on a circuit layer of a feed network constructed in accordance with the present invention.

The feed network is formed by circuit runs defined by the artwork laid out with stripline material on the nearside and farside of the circuit layer. Examples of these artworks are shown in FIGS. 32 and 33. The circuit runs 440 preferably have critical line dimensions of 0.0375±0.001". The circuit runs from each side can be connected together with plated-through holes for example.

Although the feed network invention has been described above with reference to application in an antenna, it should be noted that the invention is not limited to this particular application, but is useful in many applications desiring improved input and output return losses. For example, the feed network invention would find useful application in a balanced microwave amplifier, wherein the second hybrid coupler can be used to terminate input and output 90° hybrid couplers.

Figure 25B:
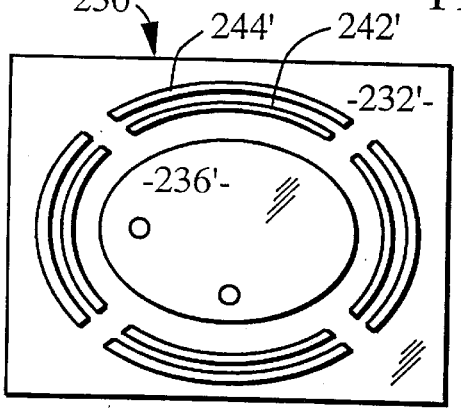
FIG. 25B is a top plan view of a modified version of the antenna of FIG. 25A with an oval patch and segmented concentric tuning strips.
Figure 25A:
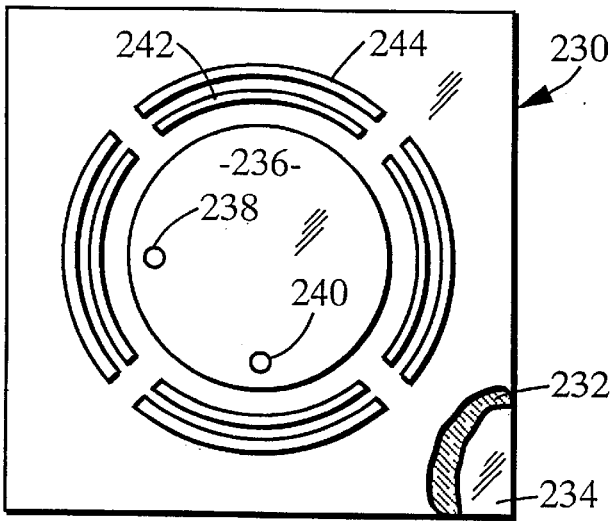
FIG. 25A is a top plan view of an antenna constructed according to the present invention with a two feed circular patch and segmented concentric tuning strips.
Figure 26:
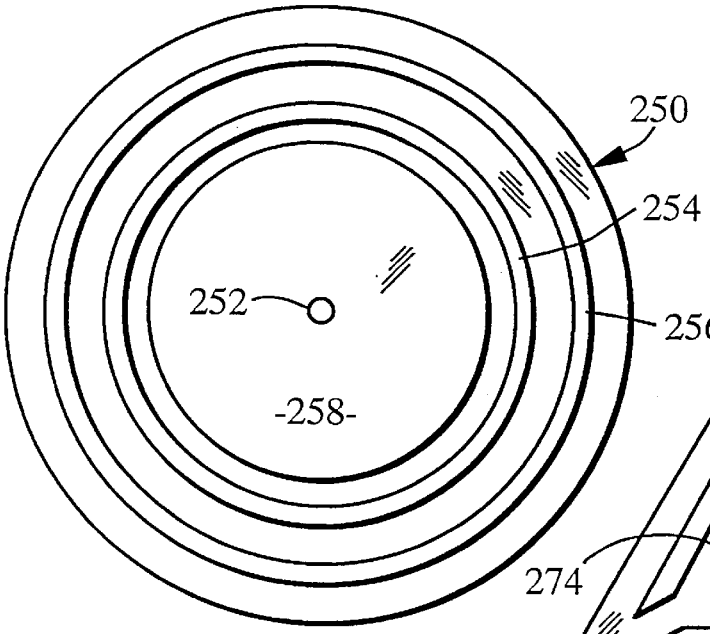
FIG. 26 is a top plan view of an antenna constructed according to the present invention with a center fed circular patch and concentric tuning strips.

Although the antenna invention has been heretofore described primarily with square patch antennas, it should be noted that other shapes are possible. For example, in FIG. 25A, a circular antenna 230 is shown mounted over a square dielectric spacer 232 and ground plane 234. The antenna 230 includes a circular patch 236 with two feeds 238 and 240 for polarization control as in the square patch antennas previously described. Two rings of segmented concentric tuning strips 242 and 244 are used to lower the resonant frequency of the antenna 230. FIG. 25B shows a similar antenna 230' where the patch 236' and rings of segmented tuning strips 242' and 244' are oval, showing that the shape of the patches 236 and 236' can be said to be shaped as a plane section of a right circular cone. Another configuration of a circular antenna 250 including the present invention is shown in FIG. 26. The antenna 250 has a central feed 252 and concentric tuning rings 254 and 256 surrounding the patch 258. The antenna 250 therefore has no means to vary the polarization or the antenna pattern, the tuning rings 254 and 256 only being useful in reducing the resonant frequency of the antenna 250.

Figure 27:
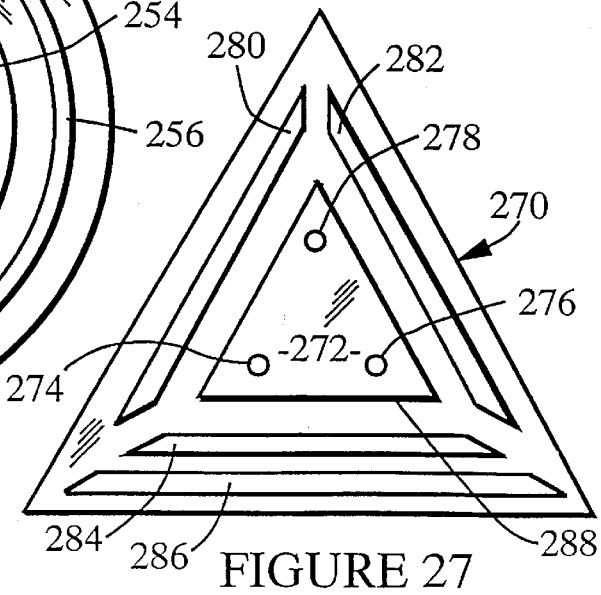
FIG. 27 is a top plan view of an antenna constructed according to the present invention with a triple feed triangular patch and uneven numbers or tuning strips spaced from the edges of the patch.

As shown in FIG. 27, almost any configuration of patches and tuning strips can be employed for special purposes. The antenna 270 of FIG. 27 includes a triangular patch 272 with three feeds 274, 276 and 278 positioned in the corners thereof. The feeds 274, 276 and 278 can be fed out of phase or fed all in the same phase so that they act like a center feed. Note that the upper sides of the triangular patch 272 have associated single tuning strips 280 and 282 while two tuning strips 284 and 286 are provided at the lower edge 288. This configuration would be used if low frequencies are only required with a directed antenna pattern.

Figure 28:
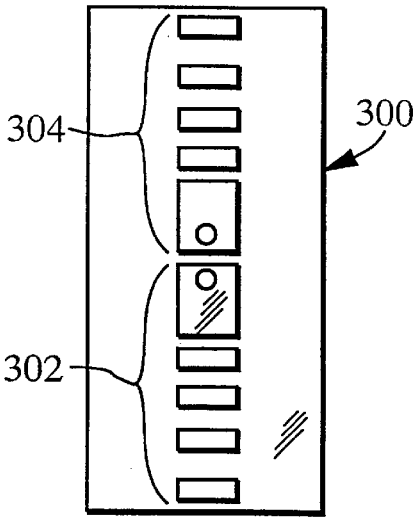
FIG. 28 is a top plan view of a pair of antennas elements constructed according to the present invention positioned back-to-back to form a frequency tunable dipole antenna.

The antenna 300 shown in FIG. 28 is essentially two of the present antennas 302 and 304 positioned back-to-back to form a tunable dipole antenna 300.

Thus, there has been shown and described novel antennas which fulfill all of the objects and advantages sought therefor. Many changes, alterations, modifications and other uses and application of the subject antennas will become apparent to those skilled in the art after considering the specification together with the accompanying drawings. All such changes, alterations and modifications which do not depart from the spirit and scope of the invention are deemed to be covered by the invention which is limited only by the claims which follow.

We claim:

1. An antenna including:

a ground plane that is electrically conductive having a first side surface;

a first patch that is electrically conducting having:
at least one edge; and
a first side surface;

a dielectric layer positioned between said first patch and said ground plane, said dielectric layer including:
a first side surface in contact with said first side surface of said first patch; and
a second side surface in contact with said first side surface of said ground plane;

at least one turning strip that is electrically conductive spaced from said at least one edge of said first patch and spaced from said ground plane by said dielectric layer;

an RF feed connected to said first patch;

switch means to electrically connect and disconnect RF energy between said at least one tuning strip and said first patch;

a hybrid coupler network connected to said RF feed, said hybrid coupler network including:
a first hybrid coupler connected between said RF feed and an RF power source, said first hybrid coupler having a portion adapted to be connected to a power termination, and
a second hybrid coupler connected to said portion of said first hybrid coupler, said second hybrid coupler being adapted to distribute power reflected from said RF feed.

2. The antenna as defined in claim 1, wherein said RF feed is a pair of feeds that are adapted to feed said RF power to two respective predetermined positions of said first patch, and wherein said hybrid coupler network is adapted to provide a desired phase of said RF power to said pair of feeds.

3. The antenna as defined in claim 1, wherein said second hybrid coupler includes high power terminations that are adapted to absorb said distributed power reflected from said RF feed, and a low power termination that is adapted to absorb secondary reflections from said high power terminations.

4. The antenna as defined in claim 2, wherein said second hybrid coupler includes high power terminations that are adapted to absorb said distributed power reflected from said RF feed, and a low power termination that is adapted to absorb secondary reflections from said high power terminations.

5. The antenna defined in claim 2, wherein said power reflected from said RF feed includes reflected power due to impedance mismatch between said pair of feeds.

6. The antenna as defined in claim 5, wherein said pair of feeds have a first impedance mismatch when RF energy is not connected between said first patch and said tuning strip and a second impedance mismatch when RF energy is connected therebetween.

7. An antenna device including:

an antenna having:
a first patch that is electrically conductive and that is dimensioned such that it has a resonant frequency when RF energy is fed thereto,
a tuning strip that, when it is electrically connected to said first patch, changes said resonant frequency thereof, and
a switch that electrically connects and disconnects RF energy between said first patch and said tuning strip;

an RF feed that feeds RF energy to said first patch; and a hybrid coupler network connected to said RF feed, said hybrid coupler network having:
a first hybrid coupler connected between said RF feed and an RF power source, said first hybrid coupler having a portion adapted to be connected to a power termination, and
a second hybrid coupler connected to said portion of said first hybrid coupler, said second hybrid coupler being adapted to distribute power reflected from said RF feed.

8. The antenna as defined in claim 7, wherein said RF feed is a pair of feeds that are adapted to feed said RF power to two respective predetermined positions of said first patch, and wherein said hybrid coupler network is adapted to provide a desired phase of said RF power to said pair of feeds.

9. The antenna as defined in claim 7, wherein said second hybrid coupler includes high power terminations that are adapted to absorb said distributed power reflected from said RF feed, and a low power termination that is adapted to absorb secondary reflections from said high power terminations.

10. The antenna as defined in claim 8, wherein said second hybrid coupler includes high power terminations that are adapted to absorb said distributed power reflected from said RF feed, and a low power termination that is adapted to absorb secondary reflections from said high power terminations.

11. The antenna defined in claim 8, wherein said power reflected from said RF feed includes reflected power due to impedance mismatch between said pair of feeds.

12. The antenna as defined in claim 11, wherein said pair of feeds have a first impedance mismatch when said tuning strip is not connected to said first patch and a second impedance mismatch when said tuning strip is connected.

13. A hybrid coupler network for matching a power source to a feed including:

a first hybrid coupler connected between said feed and said power source, said first hybrid coupler having a portion adapted to be connected to a power termination, and a second hybrid coupler connected to said portion of said first hybrid coupler, said second hybrid coupler being adapted to distribute power reflected from said feed.

14. The hybrid coupler network as defined in claim 13, wherein said feed is a pair of feeds, said first hybrid coupler being adapted to provide a desired phase of power to said pair of feeds.

15. The hybrid coupler network as defined in claim 13, wherein said second hybrid coupler includes high power terminations that are adapted to absorb said distributed power reflected from said feed, and a low power termination that is adapted to absorb secondary reflections from said high power terminations.

16. The hybrid coupler network as defined in claim 14, wherein said second hybrid coupler includes high power terminations that are adapted to absorb said distributed power reflected from said feed, and a low power termination that is adapted to absorb secondary reflections from said high power terminations.

17. The hybrid coupler network as defined in claim 14, wherein said power reflected from said feed includes reflected power due to impedance mismatch between said pair of feeds.

18. The hybrid coupler network as defined in claim 14, wherein said first hybrid coupler includes:

a first input port connected to said power source, a second input port comprising said portion adapted to be connected to said power termination, a first output port connected to one of said pair of feeds, and a second output port connected to the other of said pair of feeds, and wherein said second hybrid coupler includes:

a first input port connected to said second input port of said first hybrid coupler, a second input port connected to a first termination resistor, a first output port connected to a second termination resistor, and a second output port connected to a third termination resistor.

19. The antenna as defined in claim 1, wherein said second hybrid coupler distributes said reflected power into two independent paths of approximately equal amplitude.

20. The antenna device as defined in claim 7, wherein said second hybrid coupler distributes said reflected power into two independent paths of approximately equal amplitude.

21. The hybrid coupler network as defined in claim 13, wherein said second hybrid coupler distributes said reflected power into two independent paths of approximately equal amplitude.

22. The antenna as defined in claim 19, wherein said second hybrid coupler includes a first high power termination coupled to one of the two independent paths and a second high power termination coupled to the other of the two independent paths, the first and second high power terminations being; located at different physical locations of the antenna.

23. The antenna device as defined in claim 20, wherein said second hybrid coupler includes a first high power termination coupled to one of the two independent paths and a second high power termination coupled to the other of the two independent paths, the first and second high power terminations being located at different physical locations of the antenna device.

24. The hybrid coupler network as defined in claim 21, wherein said second hybrid coupler includes a first high power termination coupled to one of the two independent paths and a second high power termination coupled to the other of the two independent paths, the first and second high power terminations being located at different physical locations of the hybrid coupler network.

* * * * *